US007876918B2

(12) United States Patent
Luo

(10) Patent No.: US 7,876,918 B2
(45) Date of Patent: Jan. 25, 2011

(54) METHOD AND DEVICE FOR PROCESSING AN ACOUSTIC SIGNAL

(75) Inventor: Henry Luo, Waterloo (CA)

(73) Assignee: Phonak AG, Stafa (CH)

( * ) Notice: Subject to any disclaimer, the term of this patent is extended or adjusted under 35 U.S.C. 154(b) by 1788 days.

(21) Appl. No.: 11/005,946

(22) Filed: Dec. 7, 2004

(65) Prior Publication Data

US 2006/0120540 A1 Jun. 8, 2006

(51) Int. Cl.
*H04R 25/00* (2006.01)

(52) U.S. Cl. ..... 381/317; 381/98; 381/94.1; 29/896.21

(58) Field of Classification Search ..... 381/98, 381/94.1, 94.2, 94.3, 316, 317, 318, 312, 381/320; 29/896.21, 896.2
See application file for complete search history.

(56) References Cited

U.S. PATENT DOCUMENTS

| | | | | |
|---|---|---|---|---|
| 6,882,736 | B2 | 4/2005 | Dickel et al. | |
| 2002/0037088 | A1 | 3/2002 | Dickel et al. | |
| 2002/0191804 | A1 | 12/2002 | Luo et al. | |
| 2003/0147538 | A1* | 8/2003 | Elko | 381/92 |
| 2004/0175012 | A1* | 9/2004 | Roeck et al. | 381/317 |

FOREIGN PATENT DOCUMENTS

| | | | |
|---|---|---|---|
| EP | 1 229 758 | A2 | 8/2002 |
| EP | 1 339 256 | A2 | 8/2003 |
| EP | 1 450 354 | A1 | 8/2004 |
| WO | 03/059010 | A1 | 7/2003 |

* cited by examiner

*Primary Examiner*—Vivian Chin
*Assistant Examiner*—Con P Tran
(74) *Attorney, Agent, or Firm*—Pearne & Gordon LLP

(57) ABSTRACT

For reducing wind noise effects in a hearing instrument, a converted acoustic signal is processed in a number of frequency bands, a low frequency band of which is chosen to be a master band. A wind noise attenuation value is determined in each frequency band, based on a signal level in the frequency band concerned and on a signal level in the master band. A further wind noise reducing effect may be achieved in hearing instruments with at least two microphones where in the presence of wind noise the instrument may be switched from a directional mode to a omnidirectional mode in which an average of the output signals of the two microphones is used as signal. In single microphone hearing instruments, the microphone signal and a delayed version of this signal are used to improve wind noise detection and reduction.

13 Claims, 5 Drawing Sheets

METHOD AND DEVICE FOR PROCESSING AN ACOUSTIC SIGNAL

FIELD OF THE INVENTION

This invention is in the field of processing signals in or for hearing instruments. It more particularly relates to a method of converting an acoustic input signal into an output signal, a hearing instrument, and to a method of manufacturing a hearing instrument.

BACKGROUND OF THE INVENTION

Wind exists in different speeds and intensities and may vary significantly over time. When people wear hearing aids in windy environments, the action of the wind directly on the hearing aid and on objects in its immediate vicinity can cause a variety of undesirable audible effects. These effects are usually referred to as wind noise. Wind noise is a severe problem for users of hearing aids. When wind noise levels are low or medium, wind noise can mask some speech signals and the hearing aid user usually experiences decreased speech discrimination. When the wind noise levels are high, the noise level in the hearing aid can be very high, possibly in excess of 100 dB SPL. In the worst case, wind can saturate the microphone, thereby causing extremely high noise levels and discomfort for the hearing aid user. Users therefore often switch their device off in windy conditions, since in windy surroundings acoustical perception with the hearing device switched on may become worse than if the hearing device is switched off.

It is known to counteract wind noise by mechanical constructional measures. Such measures alone, however, cannot usually eliminate wind noise to a satisfying degree.

Therefore, wind noise problems have been studied and many advanced noise detection and noise cancellation technologies have been implemented in digital hearing aids to attempt to reduce the detrimental effects of wind on hearing instrument performance.

Current wind noise canceling technologies suppress wind noise with high-pass filters or subtract an estimate of the wind noise from the noisy signal. Regardless of the method, effective wind noise reduction can be achieved only if the presence of wind noise can be reliably and consistently detected.

Unfortunately, wind noise exhibits properties and features also common to other noise signals encountered in daily life. Also, depending on wind speed, direction of the wind with respect to the device, hair length of the individual, mechanical obstructions like hats and other factors, magnitude and spectral content of wind noise vary significantly. For these reasons it is often difficult to uniquely classify the presence of wind noise and extract it from other environmental noises.

However, wind noise does also have several unique characteristics that facilitate its detection. Wind noise predominantly is a low-frequency phenomenon. Many of the available wind noise detection technologies make use of the low correlation between two spatially separated microphones or make use of the unique spectral patterns exhibited by wind noise.

A known wind noise detection method detects wind noise by computing the correlation between signals produced by two microphones, as disclosed in US2002/037088. A low correlation between the outputs from two different microphones can at times be applied to reliably detect the presence of wind noise. However, the correlation of wind noise created at different sources differs. Turbulence created at microphone ports causes signals with a low correlation. On the other hand, when turbulence is created by an object or obstruction in the vicinity of the microphone openings, the resulting wind noise signals at the microphones may be highly correlated.

A second wind noise detection technique is based on the signal from a single micro-phone. This method makes use of several well know wind noise properties: high magnitudes low auto-correlation, and energy content at very low frequencies. Such a method is disclosed in EP 1 339 256. In a further development, also disclosed in EP 1 339 256, pitch filtering and nonlinear filtering have been developed to minimize the attenuation of the speech target signal.

As to wind noise reduction, a wind noise reduction technique, disclosed in US2002/037088 for hearing devices with more than one microphone, is to switch the hearing aid from a two microphone directional, or beamforming, mode to a single microphone or omnidirectional mode (sometimes referred to as omni mode) when wind noise is detected. This technique may be combined by the mentioned approach of applying a high-pass filter when switching from the directional to the omnidirectional mode.

Alternatively, WO 03/059010 discloses a method that uses two omni microphones in a hearing aid for the purpose of achieving a wind noise insensitive hearing aid. This disclosure describes the use of two microphones with different wind noise sensitivities. When wind noise is detected, the signal from the microphone with the lower wind noise sensitivity is used as the hearing aid input signal.

In a single microphone hearing device, wind noise reduction may be achieved by reducing the low frequency gain in the frequency domain or by applying a highpass filter in the time domain, as disclosed in EP 1 339 256.

It is an object of the present invention to provide methods and devices that overcome disadvantages of prior art wind noise detection and reduction approaches and which especially should be suited also for relatively high level wind noise. The methods should be computationally not expensive, so that they may be implemented also in hearing devices with limited processing power. Preferably, the methods should not be dependent on the signal correlation as a major indicator for the presence of wind noise and therefore, in the case of more than one microphone, be equally suited for wind noise caused at the microphone ports and for the wind noise caused by other objects.

SUMMARY OF THE INVENTION

For reducing wind noise effects in a hearing instrument, a converted acoustic signal is processed in a number of frequency bands, a low frequency band of which is chosen to be a master band. A wind noise attenuation value is determined in each frequency band, based on a signal level in the frequency band concerned and on a signal level in the master band.

According to a first aspect of the present invention, therefore, a method of processing a time dependent electric signal being a converted acoustic signal into a processed electric signal is provided, the method comprising the steps of

- choosing a group of frequency bands and obtaining from the converted acoustic signal or a section thereof a frequency band signal in each one of said frequency bands,
- choosing one frequency band of said group of frequency bands to be a master band, said master band having a lower central frequency than a central frequency of a majority of the frequency bands,
- evaluating in each one of said group of frequency bands using said frequency band signal, based on pre-defined criteria, a frequency band indicator value, evaluating, for each one of said frequency bands, a frequency band wind noise attenuation using the frequency band indicator value of said frequency band and using the master band indicator value (in the master band, therefore, as opposed to the further frequency bands only one frequency band indicator value is necessarily used, namely the master band's), and applying said frequency band attenuation to the converted acoustic signal in each one of said group of frequency bands, thus obtaining the processed electric signal.

In the case of low levels of detected wind noise—i.e. depending on the frequency band indicator value—the frequency band attenuation will be zero. Positive frequency band attenuation here is used for any processing step in the frequency band that reduces the output signal level compared to the situation where no wind noise would be present. Often, frequency band attenuation will be implemented in the form of a frequency band specific gain reduction. The attenuation may depend on the wind noise level and may for example be a monotonic function of the signal level in the frequency band.

The chosen course of action is based on the insight that wind noise is predominantly a low frequency phenomenon. This helps to discriminate wind noise from other sounds, namely by using the—low frequency—master band indicator value next to the indicator value of the frequency concerned for the computation of a frequency band specific attenuation.

According to a first preferred embodiment of the first aspect of the invention, the frequency band indicator value is computed based on a comparison with a level threshold: In each frequency band, the time duration of the averaged signal being above a level threshold in a certain time interval is measured. In a first variant, the band indicator value is chosen to be a first figure such as "one" (or "wind is detected") if the duration is above a duration threshold and a second figure such as "zero" ("no wind") if the duration is below said duration threshold. In a second variant, the band indicator value is chosen to be said time duration value (possibly multiplied by a constant). Variants in which merely the time duration of the signal being above a level threshold is measured (said measurement being a count in digital systems) feature the substantial advantage of being computationally very cheap. In a third variant, the band indicator value is chosen to be a weighted time duration, for example the difference between the signal and the level threshold integrated over the time sections in which the signal is higher than the level threshold.

In this first embodiment, the frequency band attenuation may be chosen to be proportional to the frequency band indicator value if the master band indicator is indicative of wind noise (first variant), or if both the frequency band indicator value and the master band indicator value exceed a certain master band threshold (second and third variant), respectively, and zero otherwise (zero meaning here that no specific attenuation is applied at this signal processing stage). It may, however, also be a more complex function of the frequency band indicator value and the master band indicator value, and/or may further depend on the signal level in the frequency band.

In the case of digital signal processing, the time duration value may simply be determined by counting signals above the level threshold. For example, a frequency band wind noise comparator may generate a positive value such as +1 if the current, preferably averaged, signal is higher than the level threshold. It may generate a negative value such as −1 if the signal is below the level threshold. A wind noise counter will integrate the results from the wind noise comparator in a run-time mode. Only if the output from the wind noise counter is higher than a pre-determined threshold value will the wind noise detector indicate the presence of wind noise in that frequency band, i.e. yield a non-zero indicator value.

The frequency band level thresholds of the different frequency bands may differ or may be identical. If they differ, preferably the threshold in lower frequency bands is higher than the level in higher frequency bands; the threshold of the master band may be the highest of all.

According to a second preferred embodiment, the computation of the frequency band indicator value includes computing a signal index, said signal index computation being performed by determining at least one of a change in intensity sub-index, an intensity modulation frequency sub-index and of a time duration sub-index and by computing said signal index from said sub-index or sub-indices, respectively. The signal index computation may more concretely be carried out in the manner exposed in US 2002/0191804, especially in paragraphs [0048] to [0050], [0053] to [0054] and [0062] referring to FIG. 3, in combination with paragraphs [0051] to [0052], [0055] to [0061] and [0063] to [0065] for the computation based on an intensity change sub-index and a modulation frequency sub-index as well as paragraphs [0074] to [0090] for the computation further based on a time duration sub-index and for general considerations concerning the different sub-indices. The patent application publication US 2002/0191804 is incorporated herein by reference in its entirety.

According to yet another embodiment, the method comprises, previous to the evaluation of the frequency band indicator value, the step of determining an average of two converted acoustic signals. These two converted signals may be, according to a first variant, acoustic signals obtained from two or more different microphones. They may be, according to a second variant, a signal from one microphone and said signal delayed by a delay time $\tau$.

Further signal processing steps may be applied before and/or after the evaluation of the frequency band attenuation, or may be applied in parallel thereto. The further signal processing steps may comprise any signal processing algorithms known for hearing aids or yet to be developed. For obtaining an acoustic output signal, the processed electric signal is transformed back to the time domain.

Further, a method for processing a time dependent electric signal being a converted acoustic signal into a processed electric signal is provided, the method comprising the steps of choosing a group of frequency bands and obtaining from the converted acoustic signal or a section thereof a frequency band signal in each one of said frequency bands, choosing one frequency band of said group of frequency bands to be a master band, said master band having a lower central frequency than a central frequency of a majority of the frequency bands, in each one of said group of frequency bands, comparing a level of the frequency band signal with a frequency band level threshold, and computing a frequency band indicator value from a result of the comparison, evaluating, for the master band, a master band wind noise attenuation as a monotonic function of the master band indicator value, evaluating, for each further one of said frequency bands, a frequency band wind noise attenuation as a monotonic function of the frequency band indicator value of said frequency band and of the master band indicator value, and applying said frequency band wind noise attenuation to the converted acoustic signal in each one of said group of frequency bands, thus obtaining the processed electric signal.

The monotonic function of the master band indicator value—and possibly also of the frequency band indicator value—may be a step function or a more complex function. The attenuation may, apart from the mentioned indicator values, also depend on further parameters.

An acoustical device according to the first aspect of the invention comprises an input transducer for converting an acoustic input signal into a converted input signal, a signal processing unit, and an output transducer, wherein the input transducer is operationally connected to the output transducer via the signal processing unit, wherein the signal processing unit, comprises a time-to-frequency domain converter for receiving the converted input signal and providing a master band signal and several further frequency band signals, for the master band signal and for each further frequency band signal, an indicator value computing stage, for the master band signal and for each frequency band signal, a wind noise attenuation computing stage, wherein said wind noise attenuation computing stage of said master band is operationally connected to an output of the master band's indicator value computing stage, and wherein said wind noise attenuation computing stage of each further frequency band is operationally connected to an output of the indicator value computing stage of said further frequency band and to the output of the master band's indicator value computing stage.

A method for manufacturing an acoustical device according to the first aspect of the invention comprises the steps of providing an input transducer to convert an acoustic input signal into a converted input signal, a signal processing unit, and an output transducer, the signal processing unit comprising a time-to-frequency domain converter for receiving the converted input signal and providing a master band signal and several further frequency band signals, for the master band signal and for each further frequency band signal, an indicator value computing stage, for the master band signal and for each frequency band signal, a wind noise attenuation computing stage, and establishing the following operational connections:

between the input transducer and the processing unit and between the processing unit and the output transducer, between outputs of the a time-to-frequency domain converter and an input of each indicator value computing stage between an output of the master band indicator value computing stage and an input of the master band wind noise attenuation computing stage between an output of each further frequency band's indicator value computing stage and a first input of said further frequency band's wind noise attenuation computing stage and between the output of the master band indicator value computing stage and a second input of said further frequency band's wind noise attenuation computing stage.

The invention also proposes to use the low correlation of wind noise in conjunction with other indicators. It has been found that by an averaging step between two signals, a smoother, more reliable wind noise detection may be achieved. This averaging may be an averaging between output signals of at least two microphones in a first variant, so that the low spatial correlation is used, or an averaging between an output signal of a microphone and the same output signal delayed by a delay time r so as to use the low correlation of wind noise along time.

According to a the second aspect of the present invention, therefore, a method of reducing disturbances, especially wind disturbances, in a hearing device is provided, the method comprising the steps of providing a first electric signal being obtained from an acoustic signal, of providing a second electric signal being obtained from an acoustic signal, of determining an average of said first and second electric signals, and of using said average as in input signal for a wind noise detecting stage.

A wind noise reducing effect according to the first variant of the second aspect of the invention may be achieved in hearing instruments with at least two microphones where in the presence of wind noise the instrument may be switched from a directional mode to a ommidirectional mode in which an average of the output signals of the two microphones is used as signal. By this simple and computationally inexpensive approach, in addition to obtaining a smoother input signal for a wind noise detecting stage, the wind noise level is reduced by up to 3 dB in average.

According to the second variant, the fist electric signal is the converted acoustic signal $x(t)$, and the second electric signal is the converted acoustic signal delayed by a delay time $x(t-\tau)$, so that the average is $s(t)=ax(t)+bx(t-\tau)$, where a,b are constants with for example $0<a,b<1$ and $a+b=1$.

An especially preferred embodiment of the second aspect of the invention is the combination with the first aspect of the invention. The averaging according to the second aspect of the invention results in a more reliable wind noise detection according to the first aspect of the invention if wind noise detection is based on the intensity level over threshold over time.

An acoustical device according to the second aspect of the invention and according to the first variant comprises a first and a second input transducer for converting an acoustic input signal into a first and a second converted input signal, a signal processing unit, and an output transducer, wherein the input transducers are operationally connected to the output transducer via the signal processing unit, wherein the signal processing unit, comprises an averaging stage operable to determine an average of the first and second converted input signal, wherein an output of said average is switchable to be operationally connected to an input of at least one further processing stage.

A method for manufacturing such an acoustical device comprises the steps of providing a first and a second input transducer to convert an acoustic input signal into a first and a second converted input signal, a signal processing unit, and an output transducer, the signal processing unit comprising an averaging stage and a switch, and of establishing an operational connection between outputs of the first and second input transducers and two inputs of the averaging stage and between an output of the averaging stage and the switch, so that said output of the averaging stage is switchable to be operationally connected to an input of at least one further processing stage.

An acoustical device according to the second variant of the second aspect comprises an input transducer for converting an acoustic input signal into a converted input signal, a signal processing unit, and an output transducer, wherein the input transducer is operationally connected to the output transducer via the signal processing unit, wherein the signal processing unit, comprises a delay stage operable to compute a delayed input signal from the converted input signal and a averaging stage operable to determine an average of the converted input signal and the delayed input signal.

A method for manufacturing such an acoustical device comprises the steps of providing an input transducer to convert an acoustic input signal into a first and a second converted input signal, a signal processing unit, and an output transducer, the signal processing unit comprising a delay stage and a averaging stage operable to determine an average of the converted input signal and the delayed input signal, and of establishing an operational connection between an output of the input transducer the delay stage, between the output of the input transducer and a first input of the averaging stage, and between an output of the delay stage and a second input of the averaging stage.

According to a third aspect of the invention, a method of processing a time dependent electric signal is provided, the method comprising the steps of choosing a group of frequency bands and obtaining from the converted acoustic signal or a section thereof a frequency band signal in each one of said frequency bands, comparing, in each one of said group of frequency bands, said frequency band signal with a frequency band level threshold, from the result of said comparison, evaluating, in each one of said group of frequency bands, a frequency band indicator value evaluating, for each one of said frequency bands, a frequency band wind noise attenuation using the frequency band indicator value of said frequency band and using the master band indicator value, and applying said frequency band wind noise attenuation to the converted acoustic signal in each one of said group of frequency bands, thus obtaining the processed electric signal.

This is based on the insight that wind noise exhibits unique spectral features. Setting individual band specific threshold levels—they may, as in embodiments of the first aspect, be factory-set or be set individually according to the needs of the user—helps to discriminate wind noise from other sounds. Also, compared to methods where the entire signal spectrum is analyzed, the proposed way of action is computationally cheap. Also the third aspect of the invention may be, according to a preferred embodiment, combined with the second aspect of the invention.

The combination of at least one of the first and of the third aspect of the invention with the second aspect of the invention features the considerable advantage that both, characteristic wind noise features concerning the spatial and/or temporal correlation and spectral features are used as indicators and that nevertheless the method is computationally not expensive.

Also in embodiments of the invention according to its third aspect, the computation of the frequency band indicator value may include computing a signal index as disclosed in US 2002/0191804, i.e. also in embodiments of the third aspect, the technique described in US 2002/0191804 may be used to confirm the detection of wind noise based on its characteristic intensity change, modulation, and/or duration characteristics.

An acoustical device according to the third aspect of the invention comprises an input transducer for converting an acoustic input signal into a converted input signal, a signal processing unit, and an output transducer, wherein the input transducer is operationally connected to the output transducer via the signal processing unit, wherein the signal processing unit, comprises time-to-frequency domain converter for receiving the converted input signal and providing a plurality of frequency band signals, for each frequency band signal, an indicator value computing stage, said indicator value computing stage comprising a comparator operable to compare a level of the frequency band signal with a level threshold and to evaluate, from this comparison, the indictor value, for each frequency band signal, a wind noise attenuation computing stage, wherein said wind noise attenuation computing stage of each frequency band is operationally connected to an output of the indicator value computing stage of said frequency band.

A method for manufacturing an acoustical device according to the third aspect of the invention compres the steps of providing an input transducer to convert an acoustic input signal into a converted input signal, a signal processing unit, and an output transducer, the signal processing unit comprising a time-to-frequency domain converter for receiving the converted input signal and providing a plurality of frequency band signals, for each frequency band signal, an indicator value computing stage, said indicator value computing stage comprising a comparator operable to compare a level of the frequency band signal with a level threshold and to evaluate, from this comparison, the indictor value for each frequency band signal, a wind noise attenuation computing stage, and of establishing the following operational connections:

between the input transducer and the processing unit and between the processing unit and the output transducer, between outputs of the a time-to-frequency domain converter and an input of the comparator of each indicator value computing stage between an output of each frequency band's indicator value computing stage and a an input of said further frequency band's wind noise attenuation computing stage.

The term "hearing instrument" or "hearing device", as understood here, denotes on the one hand hearing aid devices that are therapeutic devices improving the hearing ability of individuals, primarily according to diagnostic results. Such hearing aid devices may be Behind-The-Ear hearing aid devices or In-The-Ear hearing aid devices (including the so called In-The-Canal and Completely-In-The-Canal hearing devices). On the other hand, the term stands for devices which may improve the hearing of individuals with normal hearing e.g. in specific acoustical situations as in a very noisy environment or in concert halls, or which may even be used in context with remote communication or with audio listening, for instance as provided by headphones.

The hearing devices addressed by the present invention are so-called active hearing devices which comprise at the input side at least one acoustical to electrical converter, such as a microphone, at the output side at least one electrical to acoustical converter, such as a loudspeaker, and which further comprise a signal processing unit for processing signals according to the output signals of the acoustical to electrical converter and for generating output signals to the electrical input of the electrical to mechanical output converter. In general, the signal processing circuit may be an analog, digital or hybrid analog-digital circuit, and may be implemented with discrete electronic components, integrated circuits, or a combination of both.

BRIEF DESCRIPTION OF THE DRAWINGS

In the following, principles of the invention are explained by means of a non-limiting description of preferred embodiments. The description refers to drawings with figures that are all schematic. The figures show the following.

DESCRIPTION OF THE PREFERRED EMBODIMENT

Figure 1:
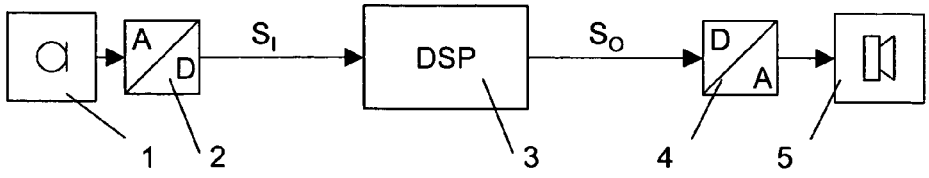
FIG. 1 a hearing aid system with a single microphone
Figure 2:
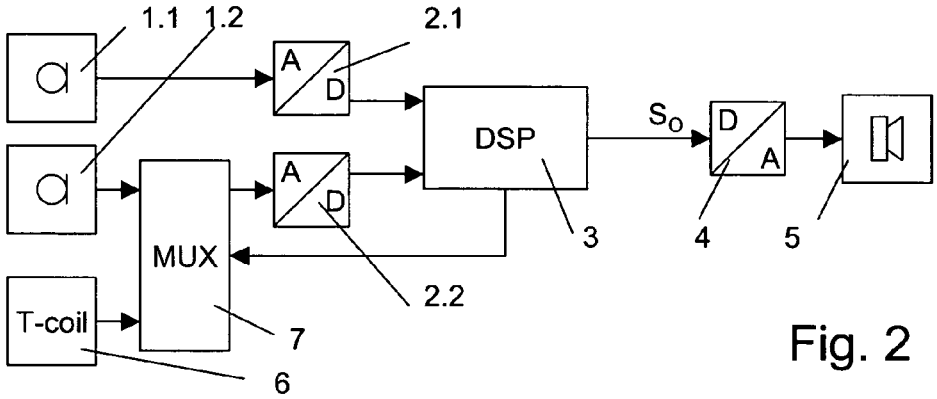
FIG. 2 a hearing aid system with dual microphones and a telecoil

A hearing aid system with a single microphone is schematically illustrated in FIG. 1. The system comprises, in a sequence, a microphone 1, an analogue-to-digital converter 2, producing an input signal, a digital signal processing stage (DSP) 3, transforming the input signal into an output signal, a digital-to-analog converter 4 and a receiver 5. A dual microphone hearing aid system as illustrated in FIG. 2 differs therefrom in that two microphones 1.1, 1.2 and accordingly two analog-to-digital converters 2.1, 2.2 are present. For dual microphone aids, there are many different modes such as omni, dual-omni, fixed beamformer and adaptive beamformer. The shown embodiment in addition comprises a telecoil 6 and a multiplexer 7, which is controlled by the DSP 3 and receives the output signals of both, the second microphone 1.2 and the telecoil. The output from the multiplexer is either the microphone 1.2 signal or the telecoil 6 signal.

Figure 3:
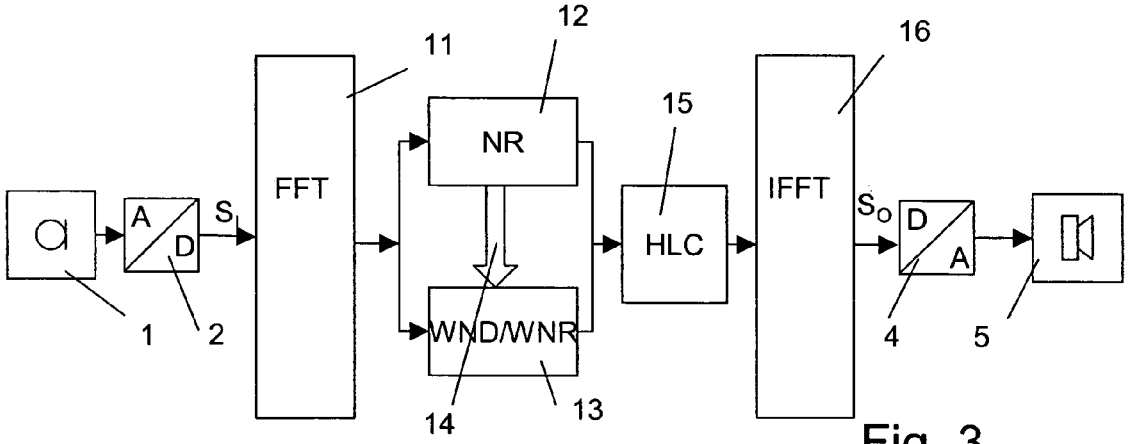
FIG. 3 an overview on a signal processing system including wind noise management FIG. 4 a diagram illustrating a method according to the first aspect of the invention FIG. 5 a diagram illustrating processing steps of an embodiment of the method according to the first aspect of the invention, in a frequency band FIG. 6 a very schematic diagram illustrating the frequency bands and level thresholds in each frequency band FIG. 7 a diagram illustrating fixed wind noise reduction FIGS. 8 and 9 diagrams illustrating adaptive wind noise reduction FIG. 10 the combination of wind noise management according to the first aspect of the invention with a noise canceller, FIG. 11 an embodiment of the second aspect of the invention.

A scheme of embodiments of the first and third aspect of the invention is schematically illustrated in FIG. 3. The sound input, a mixture of signal and noise, is first acquired by a microphone 1 or by a plurality of microphones. Then, it is converted into a digital format by at least one A/D converter 2 so as to obtain an input signal $S_I$ for the digital signal processing unit. The digital input may then be framed and windowed with a low-pass filter of length L. The windowed low-pass filter such as a Hamming Window is used to separate one band of frequencies from another and to remove the high frequency noise. The resulting windowed time segment of data may also be folded and added to generate a block of data, which is then converted from the time domain to the frequency domain, via, for example, a 2N-point fast Fourier transform (FFT) or by bandpass filters in the time-to-frequency transformation stage 11. The coefficients of the 2N-point FFT, for example, represent N frequency bands which are used to calculate the signal strength of the band in the frequency domain. The strength of the input signal (also called 'signal level' in this text), in each frequency band varies with time. According to the first aspect of the invention, the signal in each frequency band is processed by a frequency band specific wind noise detector. Adaptive noise reduction 12 according to US 2002/0191804 in the shown embodiment is applied in parallel with wind noise reduction according to the first aspect of the invention. Low-level wind noise (for example<50 dB SPL) is attenuated by a set amount (e.g., an amount between 6 dB and 12 dB) according to the adaptive noise reduction. When wind noise exceeds a certain threshold level, wind noise management 13 is activated. The adaptive noise reduction of US 2002/0191804 may then optionally control or confirm wind noise detection, as indicated by the arrow 14. In further processing stages 15—potentially including processing stages upstream of the wind noise management unit and/or between wind noise management processing steps—hearing loss correction according to the state of the art or according to methods yet to be developed is applied. A frequency-domain-to-time-domain transformation stage 16 is also illustrated in the figure.

Figure 4:
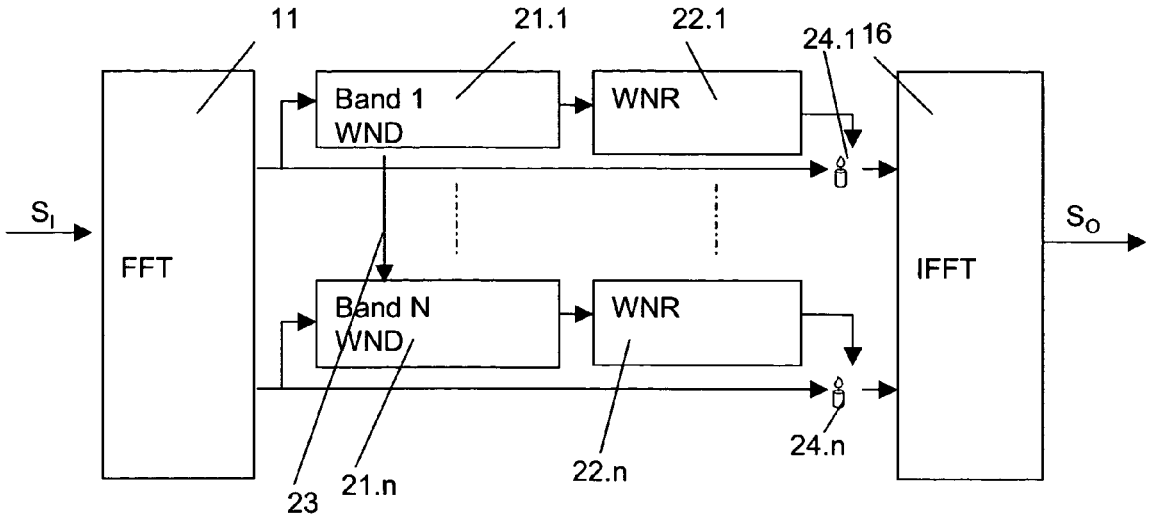

According to the first and third aspect of the invention, the signal in each frequency band is processed by a frequency band specific wind noise detector 21.1, . . . 21.n as shown in FIG. 4. Also, each frequency band comprises a frequency band specific wind noise reduction stage 22.1, . . . , 22.n. According to the first aspect, a low frequency band—usually the frequency band covering the lowest audible frequencies—is chosen to be the master band. The evaluated wind noise indicator value of the master band is—together with the wind noise indicator value of the frequency band concerned—used for determining the attenuation level in the frequency band. For example, noise detected in this frequency band is only confirmed to be wind noise if wind noise is also detected in the master band. This influence of the master band is indicated by an arrow 23 in FIG. 4. The attenuation value evaluated by the wind noise reduction stage 22.1, . . . 22.n is applied on the frequency band input signal, as illustrated by the multipliers 24.1, . . . , 24.n.

Figure 5:
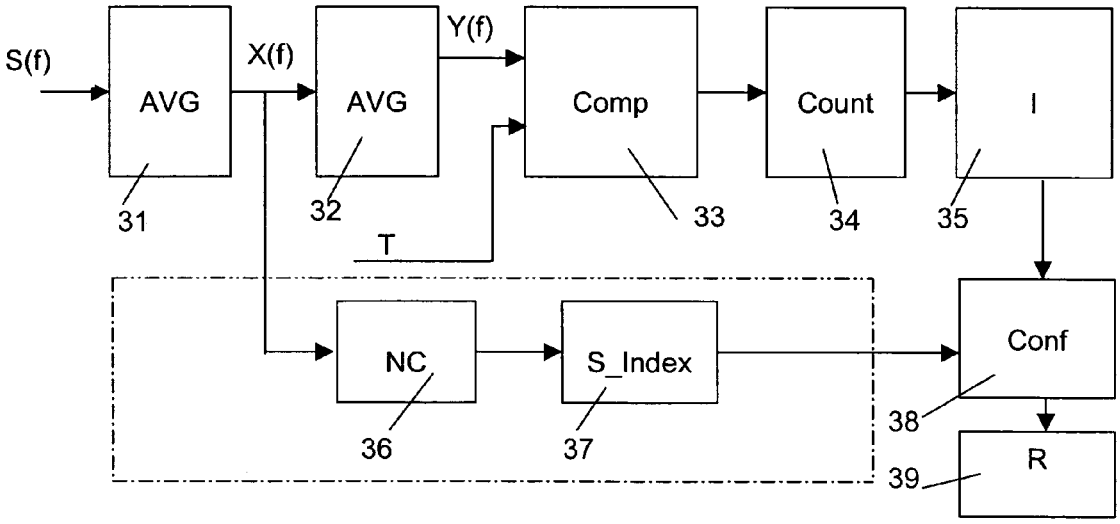

FIG. 5 shows the wind noise detection in a frequency band. Two stages of a first order averager are implemented in each frequency band. The signal S(f) in the frequency band f is first processed to produce a fast first order average, as has been implemented for signal detection in the adaptive noise reduction method of US 2002/0191804. In discrete notation, the first order averager 31 is defined by the function $x(n)=\alpha s(n)+\beta x(n-1)$, where $\beta=1-\alpha$. In z-transform notation $X(z)=H(z)\cdot S(z)$, where $$H(z) = \frac{\alpha}{1-\beta z^{-1}}.$$

The parameter $\alpha$ is a function of the time constant $\tau$ for the first order averager. Here $$\alpha = 1 - e^{-\frac{1}{\delta\tau}}$$

where $\delta=f_e$, the effective sampling frequency is related to the particular system. For example, in a typical implementation of a system with a sampling rate of 16 kHz and a total system bandwidth of 8 kHz, $\delta$ is 1000 $s^{-1}$.

The fast first order averager 31 has a short time constant (preferably between 1 ms and 10 ms, for example between 5 ms and 7 ms) in order to accurately track the fast changes of real-life signals for signal and noise detection. The fast first order averager is followed by a slow first order averager 32. The slow first order averager is used to compute the long-term signal level in the frequency band, and has a much longer time constant (preferably between 50 ms and 1500 ms, especially preferred between 200 ms and 1000 ms, for example between 500 ms and 700 ms). The signal level Y(f) after the slow first order averager is compared with a level threshold value T—being a wind noise level threshold—to determine whether the signal is higher or lower than the wind noise threshold. If the level is higher than the level threshold, the wind noise comparator 33 will generate a positive value such as +1. If the level is at or below the threshold, the comparator will generate a negative value such as −1. A wind noise counter 34 will integrate the results from the wind noise comparator 33 in run-time mode. Only if the output from the wind noise counter is higher than a pre-determined count threshold value, will the wind noise detector indicate the presence of wind noise and process the signal as wind noise in that frequency band. This is illustrated by a count threshold comparing unit 35. The count threshold value may for example be 0 or another fixed value. If the output of the wind noise counter is lower than the count threshold value, wind noise is not indicated and the signal is processed as a general signal. In this embodiment, a frequency band indicator value therefore assumes a value "1" (corresponding to "wind noise detected") or a value "0" (corresponding to "no wind noise").

In the embodiment shown in FIG. 5 wind noise detection includes using the detection method of US 2002/0191804: The signal X(f) produced by the fast averager 31 is used by a signal index computing unit 36 to determine a signal index 37 based on at least one of the change of intensity, the modulation frequency and of the signal time duration. Only if the signal index is below (or above, depending on the chosen sign convention) a certain value will wind noise be confirmed (box 38). Depending on the detection result 39, the input signal in a following step is subject to wind noise dependent attenuation.

More in general, there are numerous ways of computing, using a signal index, a frequency band indicator value.

In a first variant, as described above, the signal index is used to verify a wind noise count determined according to the first embodiment. The frequency band indicator value may be chosen to be a function of both, a wind noise duration and the signal index.

In a second variant, the indicator value is set to be the signal index. Then, the attenuation value is chosen to be a function of the signal index of the frequency band concerned and of the master band. For example, if the signal index is determined as in US 2002/0191804 to be maximal in a change-of-intensity, modulation-frequency and/or time-duration-range where the desired speech and music may be expected, the attenuation value may be proportional to the negative of the frequency band signal index plus a constant value or to the negative of the master band signal index plus a constant value, whichever is smaller.

In further variants, more complex functions of the signal index and possibly also the signal level and/or the above mentioned count may be used.

As set out above, the first stage wind noise detection in a frequency band is further considered together with the results from the master band. In an embodiment, a positive wind noise detection result (frequency band indicator value=1) in a particular band is only considered valid if in the master band wind noise has been detected, too. This corresponds to a 'logic and'-detection linked to the master band.

The signal may, in a further processing step, be processed using the noise reduction method of US 2002/0191804. This may be done whether or not wind noise has been detected and will be explained further below in somewhat more detail. Thus, the embodiment described here allows for two ways to combine the method according to the first aspect of the invention with said noise reduction method. The noise reduction method may be used for confirming a wind noise detection result and/or it may be used independently of the wind noise detection and attenuation by being applied to the signal and thus by reducing wind noise in the manner every other type of noise is reduced.

Figure 6:
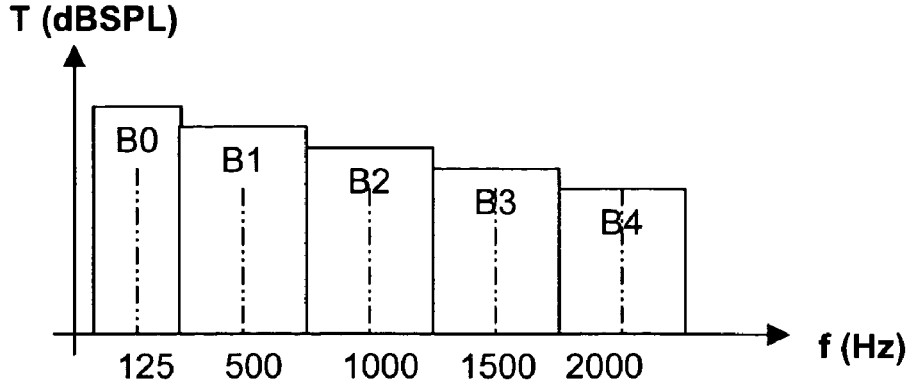

Each frequency band can have its own time constants for the fast and slow first order filters, its independent level threshold value, and possibly also its independent count threshold value. The level threshold values of an example of the invention are illustrated in FIG. 6. FIG. 6 shows the level threshold for a wind noise detection scheme including five frequency bands B0-B4. Usually, the wind noise is located primarily in the low frequency region of the audio spectrum. Therefore, in the embodiment of FIG. 6, the wind noise detection concentrates on the low frequency region below 2 kHz, although the method does not necessarily need to be restricted to only the five bands shown in FIG. 6. Rather, often more than five frequency bands will be used.

B0, the band concentrated around 125 Hz, is the master band being the frequency band that contains a dominant proportion of the wind noise energy. The level threshold in the embodiment of the figure decreases with increasing frequency.

Further, each frequency band can optionally have, in the case of combination with the noise reduction method, its own signal index according to its frequency characteristics.

Once wind noise is detected in a frequency band, wind noise reduction (being a for example frequency band specific attenuation) is applied to suppress wind noise instantaneously. The resulting signal is then supplied to the hearing loss correction component of the hearing instrument, where it may be filtered and amplified as required, whereupon it will be converted back to the time domain and converted to a sound signal.

The transformation of the signal between the time domain and the frequency domain can also be performed with other methods than FFT, for example with bandpass filters or with wavelet transforms.

In the following, two embodiments of wind noise reduction are described. Both embodiments may be combined with any wind noise detection scheme according to aspects of the invention.

Figure 7:
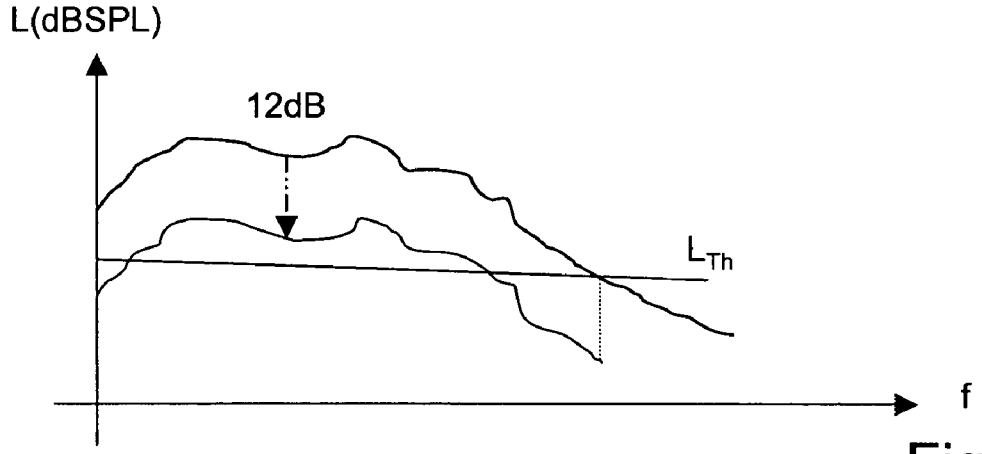

FIG. 7 illustrates fixed wind noise reduction. If the noise level is above the level threshold (i.e. if the output of the counter in the frequency band is above the count threshold) and this also applies to the master band, the noise level in the frequency band is reduced by a fixed attenuation value. Such a fixed attenuation value may be between 3 dB and 30 dB, preferably between 6 dB and 18 dB, for example 6 dB or 12 dB. In an embodiment, the attenuation value may be selected by the user.

Figure 8:
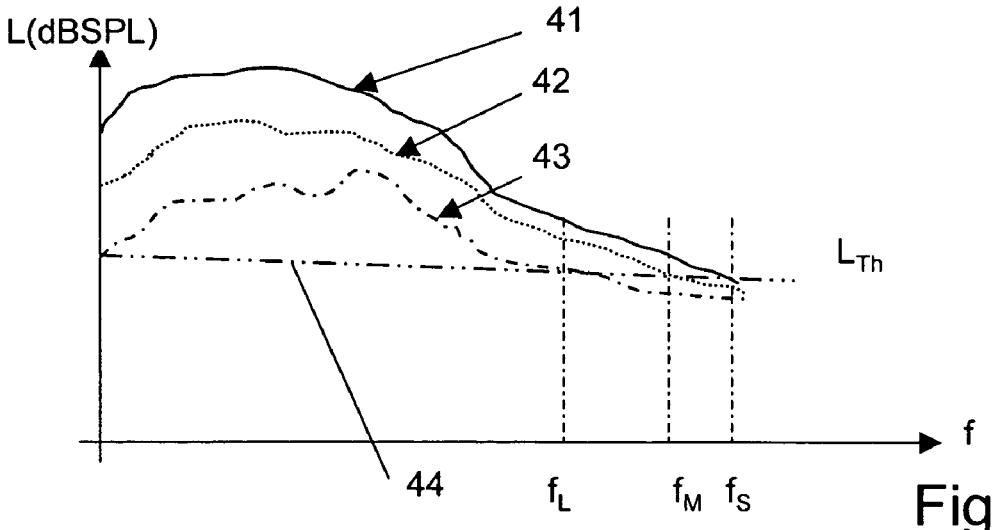
Figure 9:
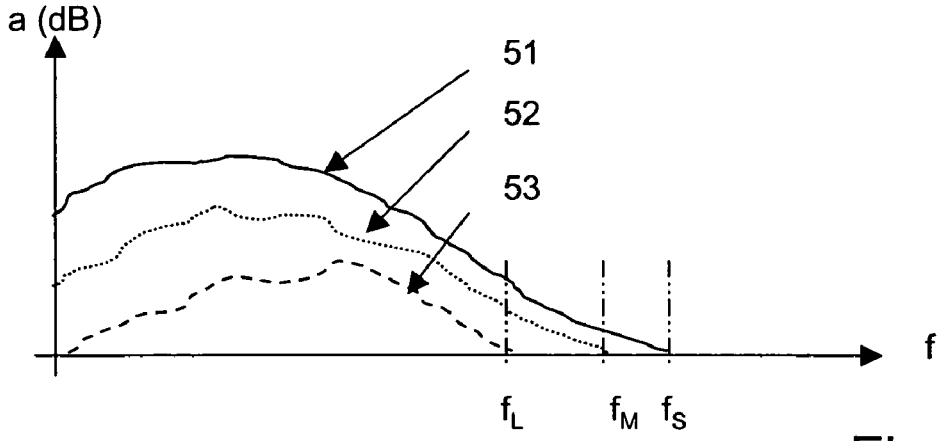
Figure 10:
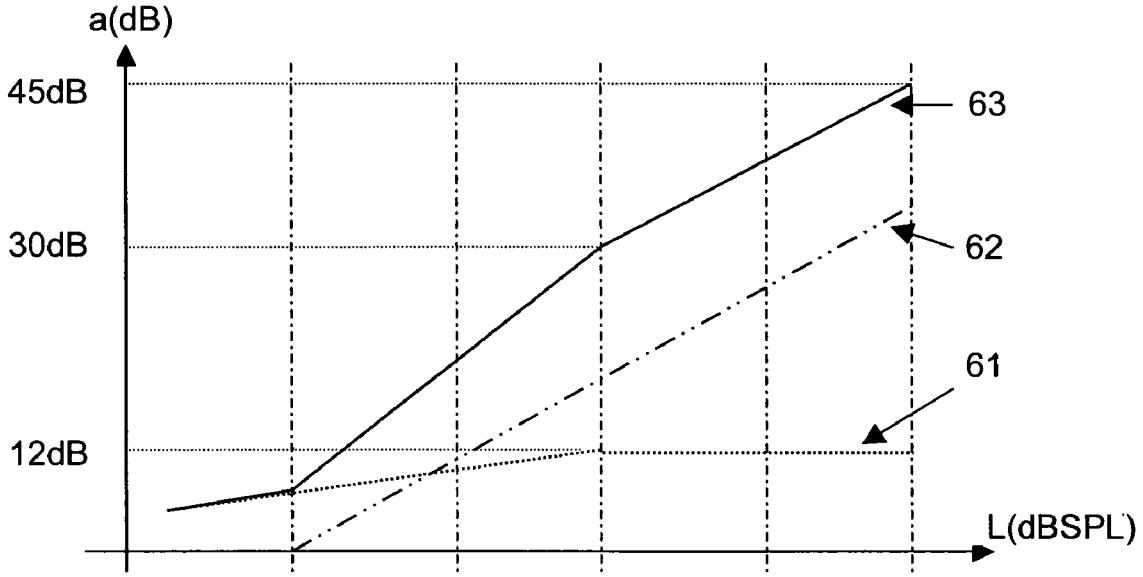

This fixed wind noise reduction helps to improve speech intelligibility and comfort with low or medium wind noise. When wind noise becomes very strong, such a wind noise reduction does not sufficiently reduce the strong wind noise levels which may still completely mask the speech signal or cause microphone saturation and considerable discomfort to the user. Therefore, for different wind speeds causing different wind noise levels, the fixed wind noise reduction may not be sufficient in a frequency band and overly aggressive in another band. Also, when wind changes its speed or direction, or when a person changes orientation with respect to wind direction, the wind noise level or pattern will change in different frequency regions. This can result in changes of wind noise level detected by wind noise detection. Such a change in wind noise detection can cause the wind noise reduction to be enabled or disabled in some frequency bands over time. The result is a modulated output signal which can be perceived as an undesirable or uncomfortable artifact. To address these limitations, an adaptive wind noise reduction strategy is proposed according to a second embodiment. The logic is that if wind noise over a certain level can be reliably detected and identified as wind noise in specific frequency bands—this detection and identification may be accomplished by the above described wind noise detection method—a stronger wind noise can be treated differently than a lower level wind noise. The actual wind noise reduction rule may be: the stronger the wind noise level, the more aggressive the wind noise reduction. This is illustrated in FIGS. 8, 9, and 10. FIG. 8 shows noise levels caused by strong wind 41, medium wind 42 and low wind 43, respectively, as a function of the frequency. Also shown is the level threshold 44 as a function of the frequency. In practice, the noise levels and the level threshold may be considered as discrete functions of the frequency, namely to provide a different specific value in each band.

The strong, medium and low wind levels have different border frequencies $f_S$, $f_M$, and $f_L$ which are the maximum frequencies for which the signal is attenuated. The attenuation as a function of the frequency for the noise level of FIG. 8 is shown in FIG. 9. As can be seen from this figure, the attenuation a for strong 51, medium 52 and low wind 53 is proportional to the difference of the respective noise level to the frequency dependent level threshold: $a(f)=c_f(L(f)-L_{Th}(f))$ where $L(f)$ and $L_{Th}(f)$ are the actual level and the threshold level, respectively, and $c_f$ is a constant, which may but does not have to be frequency dependent. More in general, the attenuation $a(f)$ is a monotonic function of $(L(f)-L_{Thr}(f))$ which is preferably 0 for $L(f)-L_{Thr}(f)=0$.

The actual (wind) noise level $L(f)$ may, for example, be obtained from the output $Y(f)$ of the slow averager 32 shown in FIG. 5.

As explained above, the noise canceling system of US 2002/0191804 may be used to confirm wind noise in a frequency band, or, more in general, to evaluate a frequency band indicator value. An other aspect of applying the mentioned noise canceling system in the context of wind noise canceling is briefly described with reference to FIG. 10. Since wind noise has many signal properties in common with stationary or pseudo-stationary noises, the noise cancelling system (NC) can detect wind noise and therefore apply adaptive noise reduction accordingly. When wind noise is low or at a medium level, NC can detect and attenuate wind noise with the same effectiveness as it attenuates any other stationary or pseudo-stationary noises as described in US 2002/0191804. Therefore, in addition to the effective wind noise reduction described above, NC may contribute additional noise reduction for all levels of wind noise. For low or medium wind noise, NC will reduce wind noise with notable improvement as it does for other types of noise. For strong or very strong wind noise, NC as described in US 2002/0191804 does not offer enough wind noise reduction. However, the combination with the above described adaptive wind noise reduction does, as is illustrated in FIG. 10. The figure shows attenuation values from the noise cancelling system 61, from the adaptive wind noise reduction method according to the relation $a(f)=c_f(L(f)-L_{Th}(f))$ 62, and a total attenuation value 63 being the sum of the aforementioned attenuation values.

Each frequency band can have a different wind noise reduction scheme depending on the wind noise level in that frequency band, thereby achieving a combined reduction from both NC and (adaptive) wind noise reduction. The actual reduction will follow the following rules in any frequency band:

- When the wind noise level is low, a level below the level threshold, only NC attenuates wind noise as well as common noises.
- When wind noise increases over the level threshold of, wind noise reduction according to embodiments of the first aspect of the invention is activated and it generates additional reduction according to the wind noise level. The higher the wind noise level, the greater the reduction from the adaptive wind noise reduction. Such an increasingly aggressive reduction mainly serves to optimize comfort for the user.
- When wind noise reaches a higher level, NC will generate the maximum reduction, which is usually limited to 12 dB or 18 dB. When the wind noise level increases over the very high level, the reduction from NC reaches its maximum value.
- The combined wind noise reduction is the sum of both NC and adaptive wind noise reduction. Overall, an optimized wind noise reduction for both improving intelligibility and comfort is achieved by the combination of NC and adaptive wind noise reduction.
- The methods are adapted to work optimally for single and dual microphone hearing aid implementations.

Each frequency band can have a different attenuation scheme from either NC or wind noise management according to the first aspect of the invention, which will create different overall wind noise reduction in each band. Therefore, the wind noise management benefit can be optimized for different users with different hearing losses and different daily life styles. If the wearer of the hearing aid is exposed to a wide open windy environment such as a golf course, the wearer may want to have a very aggressive and powerful wind noise reduction scheme. If a person lives in a city or an environment without strong winds, the person may just want to use a moderate wind noise reduction scheme. Therefore, the flexible wind noise reduction scheme invented here can bring the optimized benefit of intelligibility and comfort improvements for different people in widely different environments. This results in a personalized adaptive wind noise management for individual hearing loss and life style.

According to the second aspect of the invention, a method of reducing disturbances, especially wind disturbances, in a hearing device is provided. This aspect is based on the fact that the wind noise signals, being mainly caused by turbulences, are highly random.

A first embodiment of the second aspect concerns a hearing aid comprising at least two microphones, preferably omnidirectional microphones. In this description, the case of two microphones is described, however, this first embodiment of the second aspect of the invention also works for systems comprising more than two microphones.

In prior art hearing instruments, the hearing aid is switched from a two microphone directional, or beamforming, mode to a single microphone or omnidirectional mode when wind noise is detected. Some additional wind noise reduction might be achieved by applying a highpass filter when switching from the directional to the omnidirectional mode.

According to the second aspect of the invention, in the case of wind noise, an average of the signals of two microphones is determined instead of switching off one microphone. In other words, if the microphone outputs are $x_1(t)$ and $x_2(t)$, the method comprises the step of determining $$s(t)=ax_1(t)+bx_2(t)$$

Figure 11:
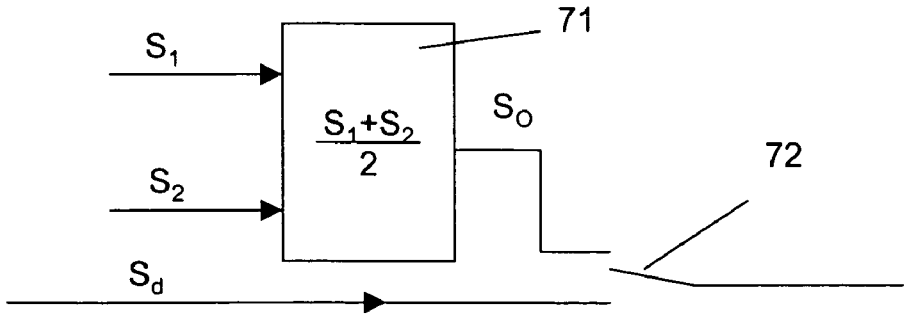

For the case where a=b=0.5, this process step is illustrated in FIG. 11, where $S_1$ and $S_2$ denote the input signals from the two microphones. The figure, next to an averager 71 (which may be a simple adder) also shows a switch 72 for switching between the averaged signal produced by the averager and the signal $S_d$ obtained conventionally in a directional mode.

Most common acoustic signals in normal environments originate from a signal source, which is further away from the two microphones than 100 times the microphone port separation. In this case, the relationship $x_2(t)=x_1(t-\tau)$ is valid, where $\tau$ is the difference in the arrival time of a signal at the port openings of microphone 1 and microphone 2. $\tau$ depends on the actual port separation, the speed of sound, and the direction of the incoming sound. For a typical port distance of 10 mm and sound coming in from a direction defined by the connecting line of the microphone port openings, the time delay is 29.4 μs. Far field acoustic signals such as speech or music signals will not be affected by replacing a single microphone output $x_1(t)$ by an averaged value s(t).

In contrast thereto, wind signals can not be treated as plain wave signals. Wind noise being the result of air turbulences at the microphone port locations leads to less correlated microphone outputs $x_1(t)$ and $x_2(t)$. Therefore, the relationship $x_2(t)=x_1(t-\tau)$ is not valid for wind noise. Instead, wind noise is a highly random signal. Therefore, determining an average s(t), being a simple and computationally inexpensive approach, reduces the wind noise level, for example by 3 dB in average if, in a preferred mode, a=b=0.5 for microphones with equal sensitivity.

The switching from a directional mode to this omnidirectional averaging mode may be done manually by the user or automatically upon detection of wind noise. For switching automatically, the wind noise detection method in accordance with the first aspect of the invention may be used.

The averaging of the two microphone input signals can be done with the raw analogue or digitized input signal or, as an alternative, can be done in frequency bands.

The at least two microphones of a hearing aid implementing the method according to the second aspect are preferably omnidirectional microphones. In this description, the case of two microphones is described, however, the second aspect of the invention also works for systems comprising more than two microphones.

Figure 12:
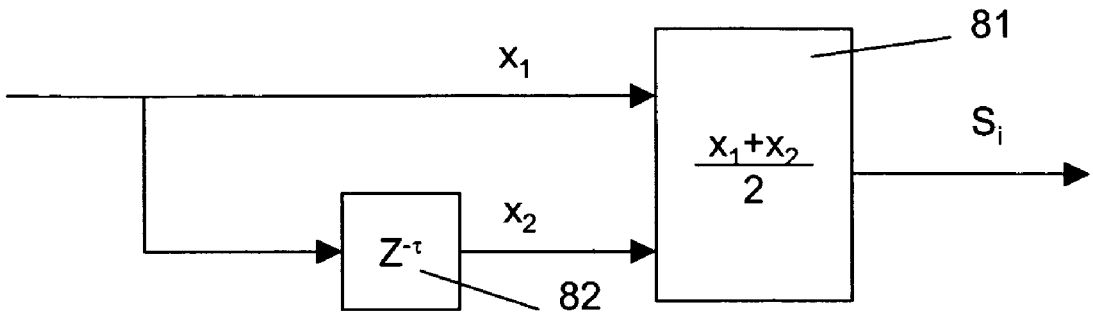
FIG. 12 an illustration of a pre-processing step for reducing fluctuations for the first aspect of the invention.

In single microphone hearing instruments, where only one microphone output exists, one may not use the low correlation of wind noise between two microphone outputs. However, it is possible to use the wind noise's low correlation along time by introducing pseudo dual-omni processing by first delaying the signal $x_1(t)$ by a time τ to produce a signal $x_2(t)=x_1(t-\tau)$. One then gets $s(t)=ax_1(t)+bx_1(t-\tau)$, where a+b=1. This is illustrated in FIG. 12, where 81 refers to the averaging stage and 82 to a delay stage. The typical delay time should be around 125 μs in order to again use the low correlation of wind noise without affecting the desired acoustic signals like speech or music. However, a delay of 125 μs acts to produce a notch in the response, and thereby a signal reduction at $f=1/(2\tau)=4$ kHz. In order to avoid adverse effects by this, a delay less than 125 μs may be chosen. More generally, as a delay time τ, a value between 40 μs and 100 μs, especially between 60 μs and 90 μs is preferred. Most preferred are delay times below 83 μs, such that a first notch is beyond 6 kHz. The effect of the approach according to this embodiment decreases if the delay time is reduced below 40 μs.

In an especially preferred embodiment of the invention, the second aspect of the invention as illustrated in FIGS. 11 and 12, is combined with the first aspect. This is due to a further advantage of the approach according to this second aspect of the invention: That determination of s(t) will produce a signal with reduced intensity level changes as a function of time. This smoothing of the signal s(t) results in a very suitable input signal for the method according to the first aspect of this invention making wind noise detection more reliable.

When the second aspect of the invention is combined with its first or third aspect, the processing stage shown in FIG. 11 or the processing stage of FIG. 12 will be arranged between the A/D converting stage(s) 2; 2.1, 2.2 and the frequency-to-time-domain-converting stage 11. In other words, its input(s) will be operationally connected to the output of the A/D converting stage(s), and its output will be operationally connected to the input of the frequency-to-time-domain-converting stage 11.

The above description of embodiments is not limiting. Various other embodiments may be envisaged. Especially, the selection of frequency bands may be arbitrarily varied, also the frequency bands used for processing do not have to cover the entire audible spectrum.

The signal processing unit does not have to be physically one unit, such as a single microprocessor but may comprise several elements processing the analog and/or digital signal, such as microprocessors, integrated circuits, Analog-to-Digital- and Digital-to-Analog-converters, filter banks, passive elements etc.

The methods according to the invention may be combined with state-of-the-art methods of reducing wind noise, for example with high-pass filtering or a method disclosed in EP 1 339 256.

Various further embodiments may be envisaged without departing from the scope or spirit of the invention.

What is claimed is:

1. A method for processing a time dependent electric signal being a converted acoustic signal into a processed electric signal, the method comprising the steps of choosing a group of frequency bands and obtaining from the converted acoustic signal or a section thereof a frequency band signal in each one of said frequency bands, choosing one frequency band of said group of frequency bands to be a master band, said master band having a lower central frequency than a central frequency of a majority of the frequency bands, evaluating in each one of said group of frequency bands using said frequency band signal, based on pre-defined criteria, a frequency band indicator value, evaluating, for each one of said frequency bands, a frequency band wind noise attenuation using the frequency band indicator value of said frequency band and using the master band indicator value, and applying said frequency band wind noise attenuation to the converted acoustic signal in each one of said group of frequency bands, thus obtaining the processed electric signal, wherein the evaluation of the frequency band indicator value comprises the steps of comparing a level of the frequency band signal with a frequency band level threshold, and integrating results of said comparison, wherein the frequency band signal is chosen to be a digital signal, wherein result of said comparison is chosen to be a first value if the level is above the level threshold and a second value different from the first value if the level is below the level threshold, and wherein the integration is a summation of the results of said comparison.

2. A method according to claim 1, wherein the frequency band level threshold of at least two different frequency bands differs.

3. A method according to claim 2, wherein the level threshold of the master band is the highest of all frequency band level thresholds of said group of frequency bands.

4. A method according to claim 1 , wherein the frequency band level threshold of all frequency bands is identical.

5. A method according to claim 1 wherein for the evaluation of the frequency band wind noise attenuation also a level of the frequency band signal is used and wherein the frequency band wind noise attenuation is a monotonic function of said level of the frequency band signal.

6. A method according to claim 1 further comprising the additional step of evaluating a frequency band signal index by determining at least one of a change of intensity, a frequency of intensity modulation and of a signal time duration in said frequency band and by determining said signal index therefrom, wherein said wind noise attenuation is evaluated dependent on said frequency band signal index.

7. An acoustical device comprising an input transducer for converting an acoustic input signal into a converted input signal, a signal processing unit, and an output transducer, wherein the input transducer is operationally connected to the output transducer via the signal processing unit, wherein the signal processing unit, comprises a time-to-frequency domain converter for receiving the converted input signal and providing a master band signal and several further frequency band signals, for the master band signal and for each further frequency band signal, an indicator value computing stage, for the master band signal and for each further frequency band signal, a wind noise attenuation computing stage, wherein said wind noise attenuation computing stage of said master band is operationally connected to an output of the master band's indicator value computing stage, wherein said wind noise attenuation computing stage of each further frequency band is operationally connected to an output of the indicator value computing stage of said further frequency band and to the output of the master band's indicator value computing stage, wherein the wind noise attenuation computing stage of each further frequency band operates to evaluate, for each one of said further frequency bands, a frequency band wind noise attenuation using the frequency band indicator value of said frequency band and using the master band indicator value, wherein at least one of said indicator value computing stages comprises a comparator for comparing a level of the frequency band signal with a level threshold, and an integrator for integrating results output by said comparator, the acoustical device further comprising an analog-to-digital converter arranged upstream of said comparator, wherein said comparator produces a first value if the level is above the level threshold and a second value different from the first value if the level is below the level threshold, and wherein the integrator operates to sum up the results of said comparison.

8. A device according to claim 7, wherein at least the wind noise attenuation computing stage of one of said frequency bands operates to provide said wind noise attenuation as a function of a level of the frequency band signal.

9. A method for manufacturing an acoustical device comprising the steps of providing an input transducer to convert an acoustic input signal into a converted input signal, a signal processing unit, and an output transducer, the signal processing unit comprising a time-to-frequency domain converter for receiving the converted input signal and providing a master band signal and several further frequency band signals, for the master band signal and for each further frequency band signal, an indicator value computing stage, for the master band signal and for each frequency band signal, a wind noise attenuation computing stage, establishing the following operational connections:

between the input transducer and the processing unit and between the processing unit and the output transducer, between outputs of the a time-to-frequency domain converter and an input of each indicator value computing stage, between an output of the master band indicator value computing stage and an input of the master band wind noise attenuation computing stage, and between an output of each further frequency band's indicator value computing stage and a first input of said further frequency band's wind noise attenuation computing stage and between the output of the master band indicator value computing stage and a second input of said further frequency band's wind noise attenuation computing stage, and enabling each further wind noise attenuation computing stage to evaluate a frequency band wind noise attenuation using a frequency band indicator value provided by the frequency band indicator value computing stage of said frequency band and using a master band indicator value provided by said master band indicator value computing stage, wherein at least one of said indicator value computing stages comprises a comparator for comparing a level of the frequency band signal with a level threshold and an integrator, for integrating results output by said comparator, wherein an analog-to-digital converter is arranged upstream of said comparator, and wherein said comparator produces a first value if the level is above the level threshold and a second value different from the first value if the level is below the level threshold, and wherein the integrator is operable to sum up the results of said comparison.

10. A method for processing a time dependent electric signal being a converted acoustic signal into a processed electric signal, the method comprising the steps of choosing a group of frequency bands and obtaining from the converted acoustic signal or a section thereof a frequency band signal in each one of said frequency bands, comparing, in each one of said group of frequency bands, a level of said frequency band signal with a frequency band level threshold, from the result of said comparison, evaluating, in each one of said group of frequency bands, a frequency band indicator value, said evaluating including integrating results of said comparison, evaluating, for each one of said frequency bands, a frequency band wind noise attenuation using the frequency band indicator value of said frequency band, and applying said frequency band wind noise attenuation to the converted acoustic signal in each one of said group of frequency bands, thus obtaining the processed electric signal, wherein the frequency band signal is chosen to be a digital signal, wherein the result of said comparison is chosen to be a first value if the level is above the level threshold and a second value different from the first value if the level is below the level threshold, and wherein the frequency band indicator value is determined by a summation of the results of said comparison at different points in time.

11. A method according to claim 10, wherein the frequency band level thresholds of at least two different frequency bands differ.

12. A method according to claim 10 , wherein said time-dependent electric signal is evaluated by determining an average of a first time dependent electric signal being a converted acoustic signal obtained from a first acoustical-to-electrical converter and of a second time dependent electric signal being a converted acoustic signal obtained from a second acoustical-to-electrical converter, the first and second acoustical-to-electrical converter being placed at different positions.

13. A method according to claim 10 , wherein said time-dependent electric signal is evaluated by determining an average of a converted input signal obtained from an acoustical-to-electrical signal converter and of a delayed input obtained by delaying said converted input signal by a pre-determined delay time $\tau$.

* * * * *